US007963120B2

(12) United States Patent
An et al.

(10) Patent No.: US 7,963,120 B2
(45) Date of Patent: Jun. 21, 2011

(54) ICE SUPPLY DEVICE AND REFRIGERATOR HAVING AN ICE CONTAINER CAPABLE OF BEING SEPARATED FROM AN ICE BREAKING UNIT

(75) Inventors: Jae Koog An, Gwangju (KR); Jung Rae Kim, Seoul (KR); Jong Yeob Kim, Gwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 441 days.

(21) Appl. No.: 12/081,774

(22) Filed: Apr. 21, 2008

(65) Prior Publication Data

US 2009/0133428 A1 May 28, 2009

(30) Foreign Application Priority Data

Nov. 26, 2007 (KR) ..... 10-2007-0120784

(51) Int. Cl.
*F25C 5/18* (2006.01)

(52) U.S. Cl. ..... 62/344; 62/320

(58) Field of Classification Search ..... 62/320, 62/340–356; 241/DIG. 17
See application file for complete search history.

(56) References Cited

U.S. PATENT DOCUMENTS

| | | | | |
|---|---|---|---|---|
| 4,745,773 | A * | 5/1988 | Ando | 62/320 |
| 4,786,002 | A * | 11/1988 | Mitsubayashi et al. | 241/101.8 |
| 6,082,130 | A * | 7/2000 | Pastryk et al. | 62/344 |
| 7,017,363 | B2 * | 3/2006 | Lee et al. | 62/320 |
| 2009/0133428 | A1 * | 5/2009 | An et al. | 62/320 |

* cited by examiner

*Primary Examiner* — Melvin Jones
(74) *Attorney, Agent, or Firm* — Staas & Halsey LLP

(57) ABSTRACT

An ice supply device and a refrigerator having the same are disclosed. The ice supply device includes an ice breaking unit having a breaker to break ice and a housing to house the breaker, an ice storage container removably coupled to the ice breaking unit and having a discharge hole to discharge ice, and a binding device to bind the ice storage container and the ice breaking unit. Accordingly, the ice storage container can be separated from the ice breaking unit, thereby facilitating handling of the ice storage container.

22 Claims, 9 Drawing Sheets

ICE SUPPLY DEVICE AND REFRIGERATOR HAVING AN ICE CONTAINER CAPABLE OF BEING SEPARATED FROM AN ICE BREAKING UNIT

CROSS-REFERENCE TO RELATED APPLICATION

This application claims the benefit of Korean Patent Application No. 2007-0120784, filed on Nov. 26, 2007 in the Korean Intellectual Property Office, the disclosure of which is incorporated herein by reference.

BACKGROUND OF THE INVENTION

1. Field of the Invention

The present invention relates to an ice supply device and a refrigerator having the same, and more particularly, to an ice supply device and refrigerator having an ice storage container and an ice breaking unit.

2. Description of the Related Art

A refrigerator disclosed in U.S. Pat. No. 6,082,130 includes an ice making device mounted at an inner upper portion of a freezing compartment, and an ice supply device, which stores ice made by the ice making device and supplies ice to an ice receiving space provided at a front surface of a door of the freezing compartment.

The ice supply device is mounted at an inner surface of the door of the freezing compartment. The ice supply device includes an ice storage container to store ice, an auger rotatably mounted in the ice storage container to feed the ice, an ice breaking device to break the ice to be dispensed, and a driving device. The ice breaking device is mounted at an inner lower portion of the ice storage container, and the auger is connected to an upper portion of the ice breaking device, so as to be driven together with the ice breaking device by the operation of the driving device.

The driving device includes a driving motor embedded in the door of the freezing compartment, and a driving shaft extending upward from the driving motor and connected to the ice breaking device. The ice storage container is removably coupled to the inner surface of the door of the freezing compartment so as to be separated as needed. When the ice storage container is separated, the ice breaking device provided in the ice storage container is separated together with the ice storage container. If the ice storage container is installed to the door of the freezing compartment, the ice breaking device is connected with the driving shaft. Thereby, a rotational force of the driving motor can be transmitted to the ice breaking device.

However, because the above-described ice supply device is configured such that the ice storage container and the ice breaking device are integrally formed, when a user intends to separate the ice storage container to clean the same or intends to carry the ice storage container in the state of being filled with ice, there is inconvenience in handling the ice storage container due to heavy weight.

SUMMARY OF THE INVENTION

The present invention has been made in order to solve the above problems. It is an aspect of the invention to provide an ice supply device capable of easily separating an ice storage container from an ice breaking unit, to thereby give a user convenience in use.

It is another aspect of the invention to provide a refrigerator having the above ice supply device.

Additional aspects and/or advantages of the invention will be set forth in part in the description which follows and, in part, will be obvious from the description, or may be learned by practice of the invention.

In accordance with an aspect of the invention, there is provided an ice supply device comprising: an ice breaking unit having a breaker to break ice and a housing to house the breaker; an ice storage container removably coupled to the ice breaking unit, the ice storage container having a discharge hole to discharge ice; and a binding device to bind the ice storage container and the ice breaking unit or release the binding.

The ice storage container may include an auger rotatably mounted therein. When the ice storage container is coupled to the ice breaking unit, the auger may be connected with the breaker.

The breaker may include a driving shaft mounted in the housing, the driving shaft having a rotational center coinciding with a rotational center of the auger, a plurality of rotating cutters coupled to the driving shaft, an ice guide part provided in the housing to surround the rotating cutters, and a plurality of fixed cutters fixed in the ice guide part to break ice by cooperating with the rotating cutters.

The ice breaking unit may include a driving device mounted in the housing to drive the breaker.

The ice breaking unit may include a first ice dispensing passage formed at the housing so that ice in the ice storage container detours around the breaker and is dispensed, and a second ice dispensing passage formed at the housing so that ice in the ice storage container is dispensed via the breaker.

The ice breaking unit may include a diverting device to divert an ice dispensing path so that ice is selectively dispensed through any one of the first ice dispensing passage and the second ice dispensing passage.

The diverting device may include a diverting member hingedly mounted in the housing to divert the ice dispensing path, and a diverting motor to rotate the diverting member.

The binding device may include a first latching part movably mounted to the ice storage container, and a second latching part provided at the ice breaking unit to latch the first latching part.

The binding device may further include an elastic member to move the first latching part so that the first latching part is latched by the second latching part, and a push part connected to the first latching part to manipulate the first latching part.

The ice storage container may be loaded above the ice breaking unit. The binding device may include a moving member mounted under the ice storage container, movably in a traverse direction, a push part connected to the moving member and partially exposed to an outside of the ice storage container, at least one first latching part provided at the moving member, at least one second latching part provided at a top of the ice breaking unit so that the first latching part is latched by or released from the second latching part, and an elastic member to move the moving member so that a latched state between the first latching part and the second latching part is maintained.

In accordance with another aspect of the invention, there is provided an ice supply device comprising: an ice breaking unit having a breaker to break ice and a housing to house the breaker; and an ice storage container removably coupled to the ice breaking unit.

In accordance with yet another aspect of the invention, there is provided a refrigerator comprising: a main body having a freezing compartment; a door to open or close the freezing compartment, the door having a dispensing chute to dispense ice; an ice making device mounted in the freezing compartment; and an ice supply device to store ice supplied from the ice making device and supply ice to the dispensing chute, the ice supply device including an ice breaking unit having a breaker mounted to an inner side of the door to break ice and a housing to house the breaker, an ice storage container removably coupled to an upper portion of the ice breaking unit, the ice storage container having a discharge hole to discharge ice, and a binding device to bind the ice storage container and the ice breaking unit or release the binding.

BRIEF DESCRIPTION OF THE DRAWINGS

These and/or other aspects and advantages of the exemplary embodiments of the invention will become apparent and more readily appreciated from the following description of the embodiments, taken in conjunction with the accompanying drawings, of which.

DETAILED DESCRIPTION OF THE PREFERRED EMBODIMENTS

Figure 1:
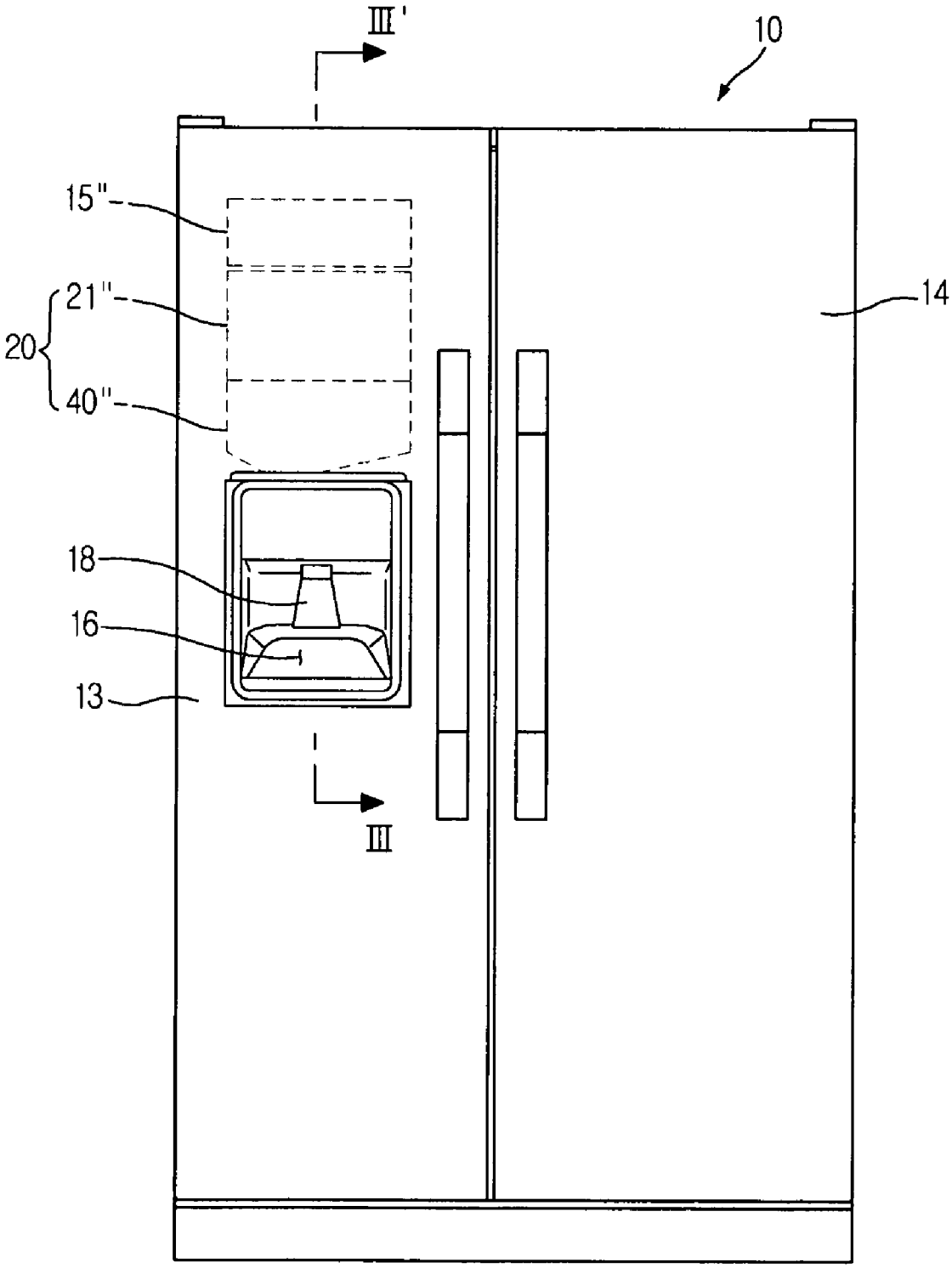
FIG. 1 is a front view of a refrigerator according to the present invention.

Reference will now be made in detail to exemplary embodiments of the present invention, examples of which are illustrated in the accompanying drawings, wherein like reference numerals refer to like elements throughout. The embodiments are described below to explain the present invention by referring to the figures.

Figure 2:
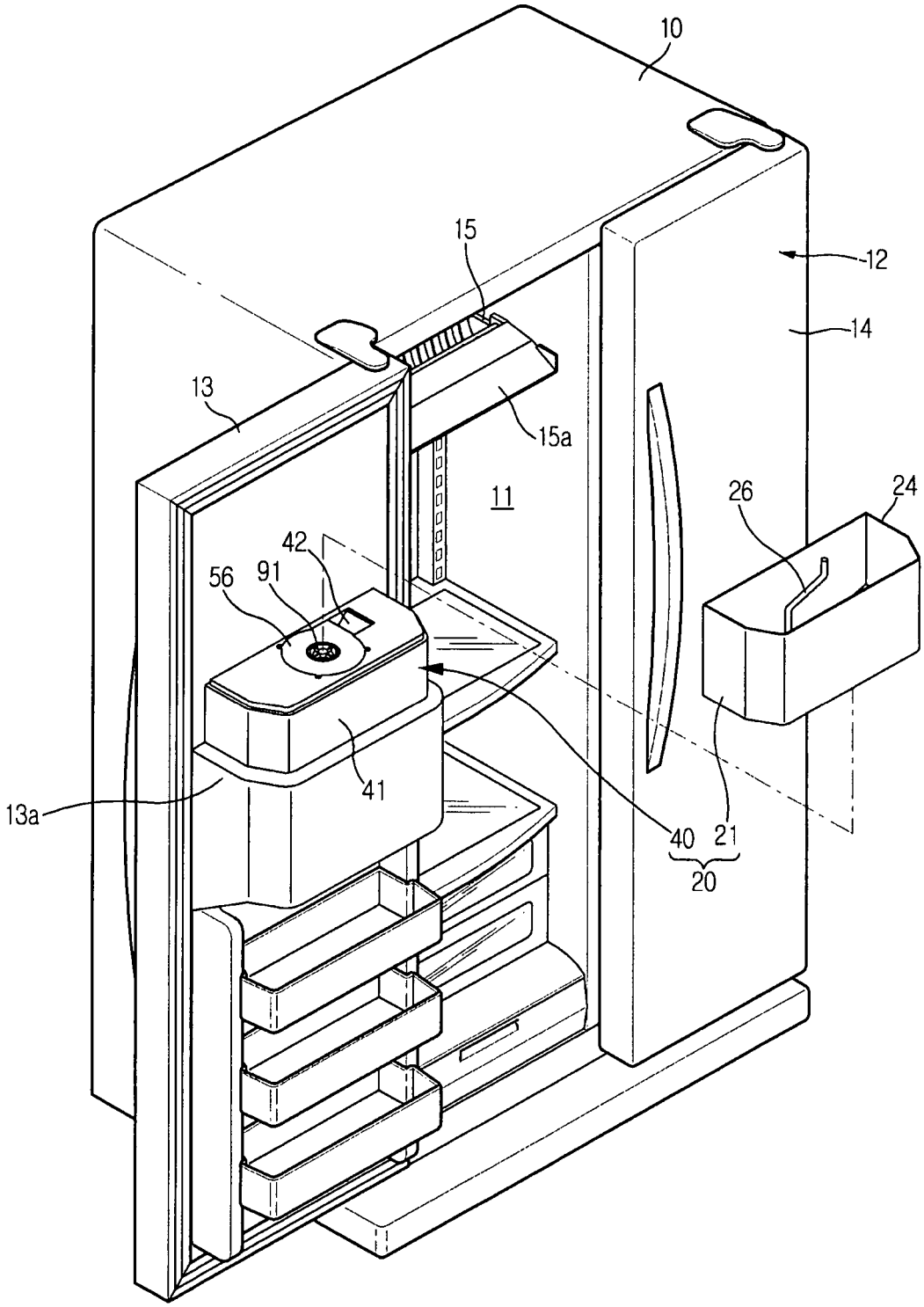
FIG. 2 is a perspective view of a refrigerator according to the present invention.

As shown in FIGS. 1 and 2, a refrigerator according to the present invention includes a main body 10, which has an internal space sectioned into a freezing compartment 11 on a left side and a cooling compartment 12 on a right side, and a freezing compartment door 13 and a cooling compartment door 14, which are respectively coupled to both sides of a front surface portion of the main body 10 to open or close the freezing compartment 11 and the cooling compartment 12. Although not illustrated in the drawings, a cooling device to cool down the freezing compartment 11 and the cooling compartment 12 is mounted in the main body 10. The cooling device may include an evaporator, a condenser, a compressor, a refrigerant expansion device, etc.

Figure 3:
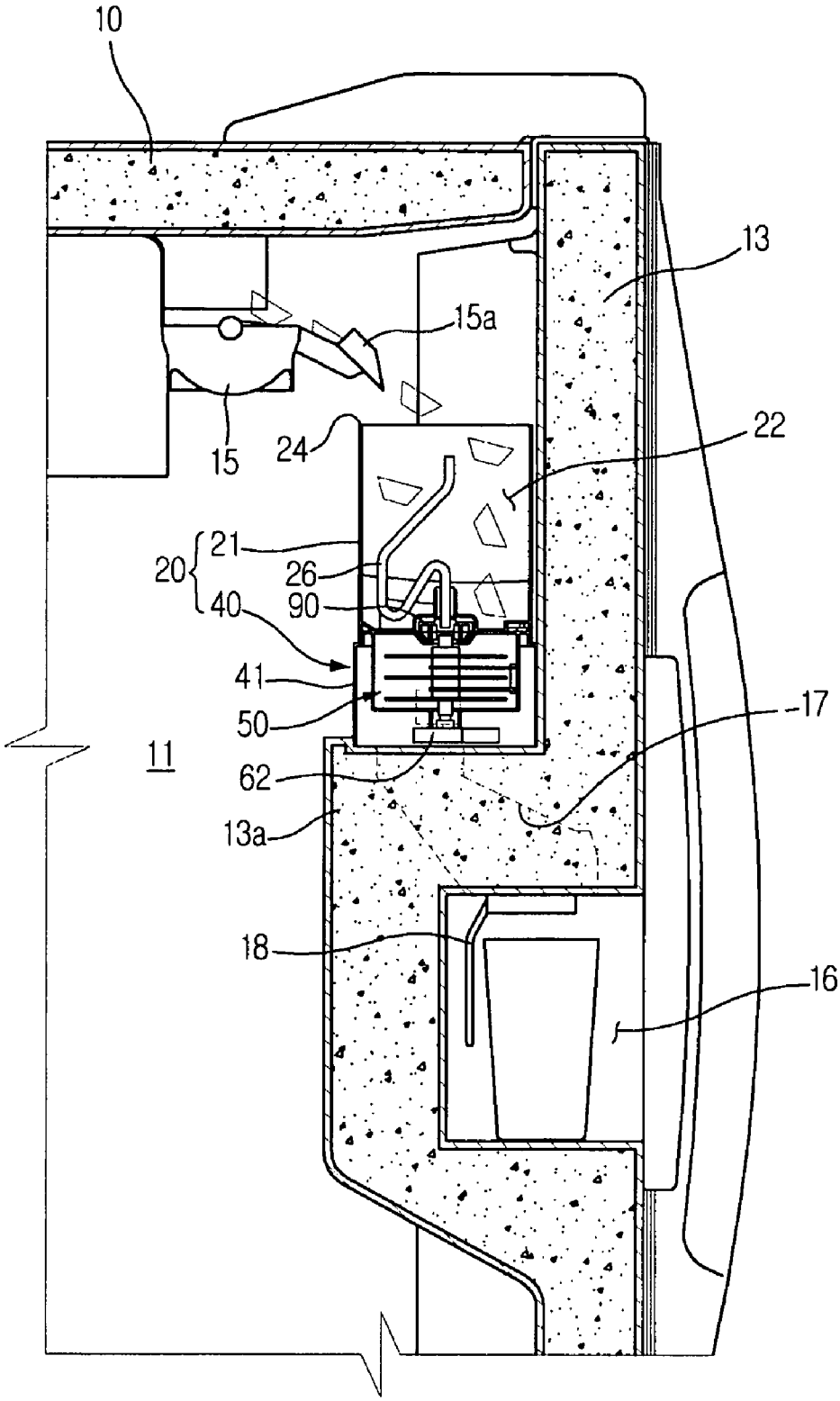
FIG. 3 is a sectional view taken along line III-III' in FIG. 1.

As shown in FIGS. 2 and 3, inside the freezing compartment 11 are mounted an ice making device 15 to make ice, and an ice supply device 20 to store ice made by the ice making device 15 and supply ice to an ice receiving space 16 provided at a front surface of the freezing compartment door 13. The ice making device 15 is fixed to an inner top surface of the freezing compartment 11, and the ice supply device 20 is mounted at an inner surface of the freezing compartment door 13.

As shown in FIGS. 1 and 3, the ice receiving space 16 is depressed from the front surface of the freezing compartment door 13 by a predetermined depth, so that a cup or a bowl can be introduced into the ice receiving space 16 to receive ice therein. The freezing compartment door 13 is provided with a dispensing chute 17, which communicates the ice supply device-mounted surface with the ice receiving space 16. The dispensing chute 17 guides ice discharged from the ice supply device 20 to the ice receiving space 16. Inside the ice receiving space 16 is mounted a manipulating lever 18, which opens or closes an outlet of the dispensing chute 17 and drives the ice supply device 20.

The ice supply device 20, as shown in FIGS. 2 and 3, includes an ice storage container 21 to store ice, and an ice breaking unit 40 to break ice discharged from the ice storage container 21. The ice breaking unit 40 is mounted on a top surface of a supporting portion 13*a* provided protrudingly from the inner surface of the freezing compartment door 13, and the ice storage container 21 is mounted above the ice breaking unit 40. Since the ice storage container 21 is removably coupled to the top surface of the ice breaking unit 40, as shown in FIG. 2, the ice storage container 21 can be easily separated from the ice breaking unit 40 as needed.

Figure 4:
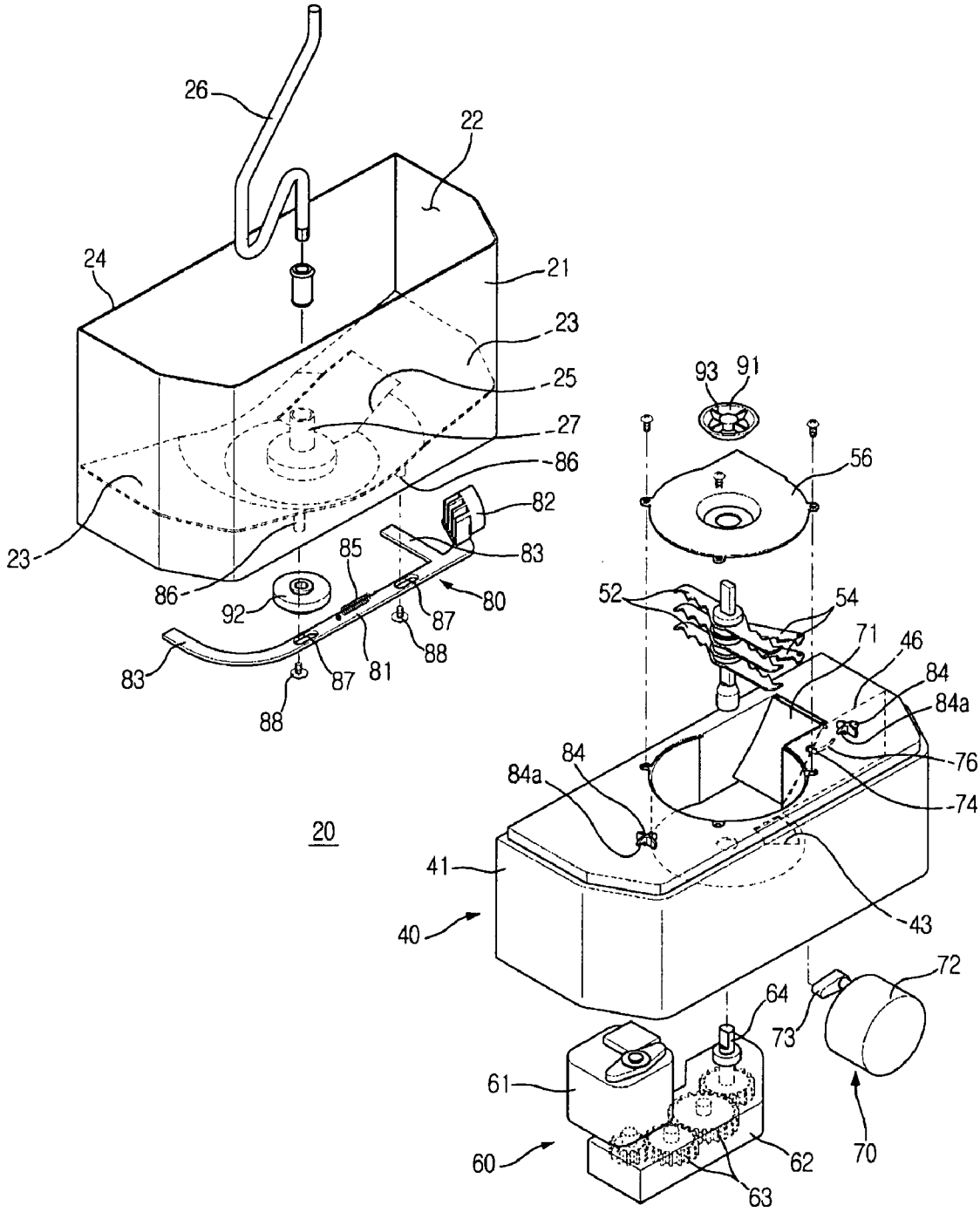
FIG. 4 is an exploded perspective view of an ice supply device according to the present invention.

As shown in FIG. 4, the ice storage container 21 has an accommodating space 22 to accommodate ice therein and an opened top surface. The ice storage container 21 also has a bottom surface 23, which is inclined substantially toward the center portion so that ice accommodated in the accommodating space 22 can be easily discharged. As shown in FIG. 3, when the ice storage container 21 is mounted at the inner surface of the freezing compartment door 13, an upper opening 24 of the ice storage container 21 is located below an ice guide plate 15*a* of the ice making device 15. Therefore, the ice made by the ice making device 15 can be received in the ice storage container 21. It is illustrated in FIG. 3 that the ice making device 15 is mounted at the inner upper portion of the freezing compartment 11, however the ice making device may be mounted at the inner surface of the freezing compartment door 13, above the ice storage container 21, so as to supply ice to the ice storage container 21.

The inclined bottom surface 23 of the ice storage container 21 is formed with a discharge hole 25, through which ice is discharged. The discharge hole 25 may be formed at a position which is a little deviated from the center of the bottom surface 23. An auger 26 is mounted in the ice storage container 21, to push ice to the discharge hole 25 by rotation. The auger 26 has a curved shape in a substantially crank shape, and a lower end portion of the auger 26 is rotatably supported by a supporting part 27 provided on the bottom surface 23. The auger 26 is connected with a breaker 50 of the ice breaking unit 40, which will be described later, and thus is rotated by the operation of the breaker 50.

Figure 8:
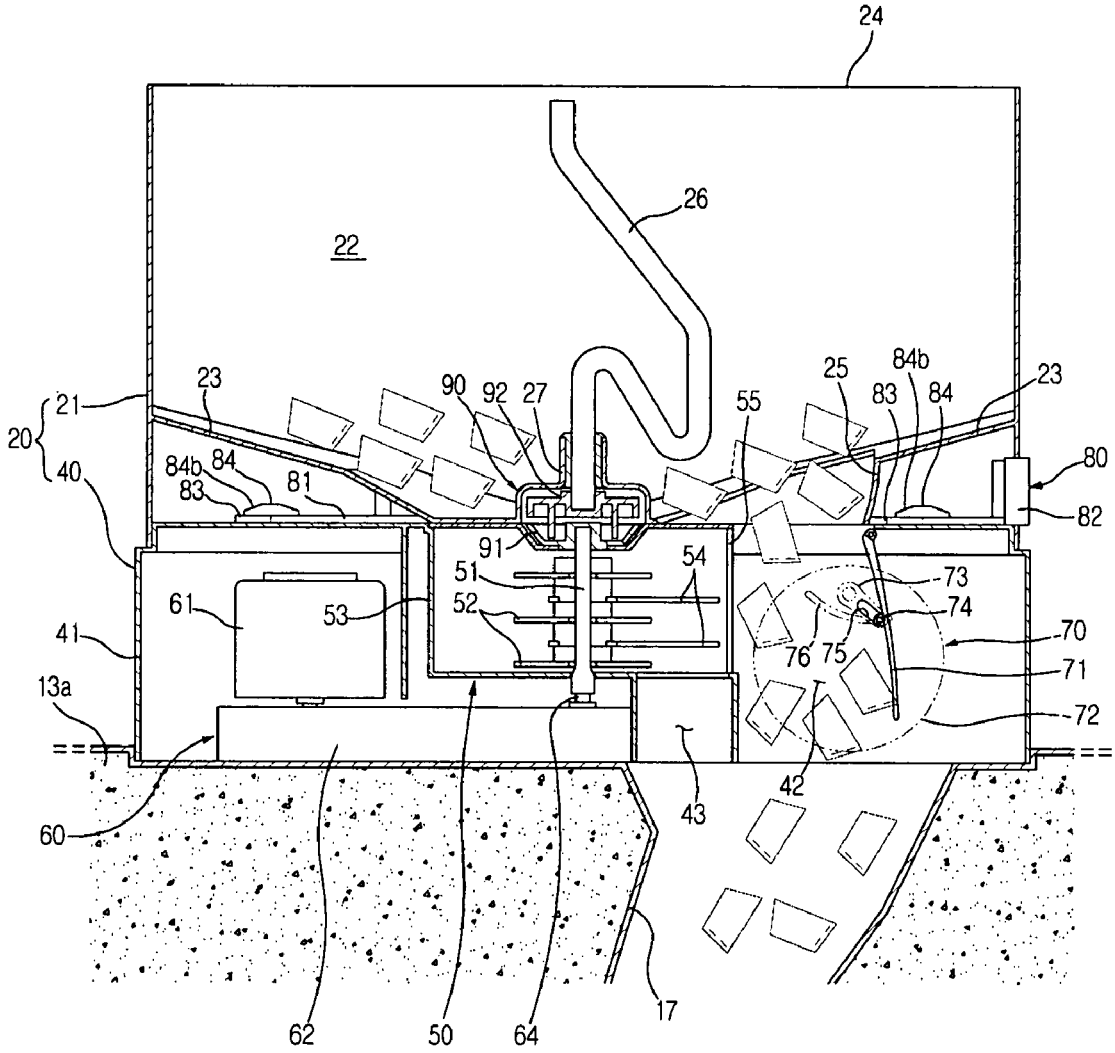
FIG. 8 is a longitudinal-sectional view of an ice supply device according to the present invention, which shows a state of dispensing ice through a first ice dispensing passage.

The ice breaking unit 40, as shown in FIGS. 4 and 8, includes the breaker 50 to break ice, a housing 41 to house the breaker 50, and a driving device 60 mounted in the housing 41 to drive the breaker 50. Also, inside the housing 41 are provided a first ice dispensing passage 42 which is formed next to the breaker 50 so that ice discharged from the ice storage container 21 detours around the breaker 50 and is dispensed without break, and a second ice dispensing passage 43 which is formed so that ice discharged from the ice storage container 21 is dispensed via the breaker 50. The second ice dispensing passage 43 is positioned below the breaker 50. Also, inside the housing 41 is mounted a diverting device 70 which diverts the dispensing path so that ice is selectively dispensed through any one of the first and second ice dispensing passages 42 and 43. The first ice dispensing passage 42 and the second ice dispensing passage 43 commonly have an inlet so as to communicate with the discharge hole 25 of the ice storage container 21. An outlet of the first ice dispensing passage 42 and an outlet of the second ice dispensing passage 43 are positioned above an inlet of the dispensing chute 17, so that the discharged ice is guided into the dispensing chute 17.

Figure 7:
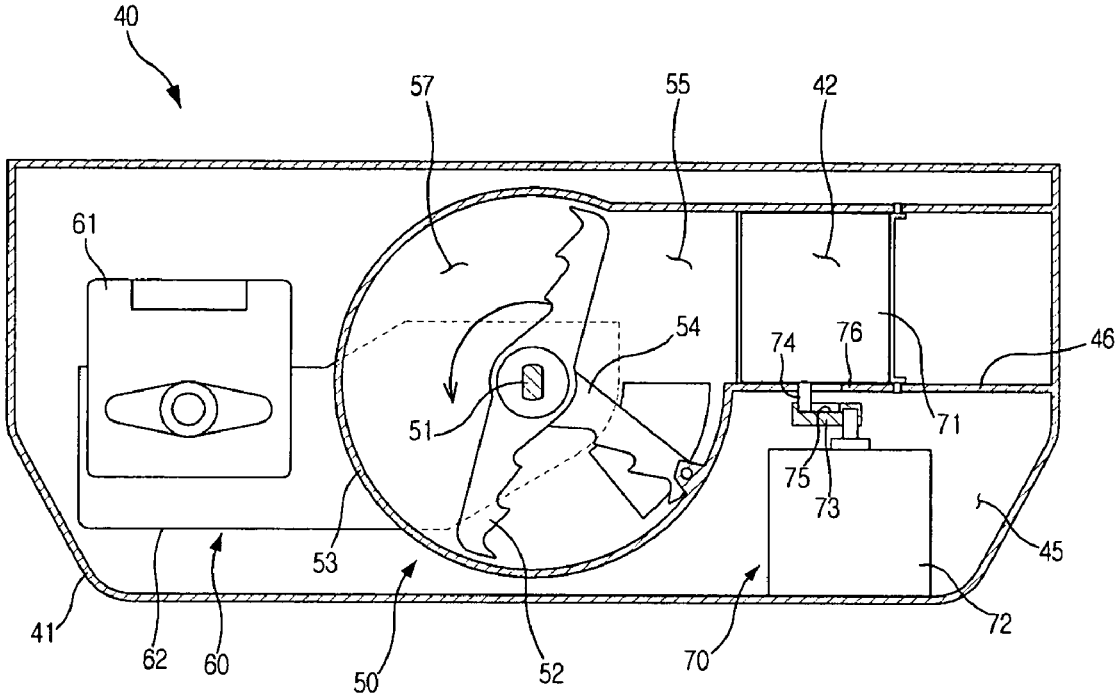
FIG. 7 is a cross-sectional view of an ice breaking unit of an ice supply device according to the present invention.

As shown in FIGS. 4 and 7, the breaker 50 includes a driving shaft 51 mounted in the housing 41 and having a rotational center coinciding with a rotational center of the auger 26, a plurality of rotating cutters 52 coupled to the driving shaft 51, a cylindrical ice guide part 53 provided in the housing 41 to surround the rotating cutters 52, and a plurality of fixed cutters 54 provided in the ice guide part 53, above the second ice dispensing passage 43, to break ice by cooperating with the rotating cutters 52. The fixed cutters 54 are disposed among the rotating cutters 52. One side surface of the ice guide part 53 is provided with an ice introducing hole 55, which communicates with the first ice dispensing passage 42, so that ice can be introduced into the ice guide part 53. By such a configuration, when the rotating cutters 52 are rotated, the ice introduced into the ice guide part 53 through the ice introducing hole 55 is broken by the rotating cutters 52 and the fixed cutters 54, and then moves to the second ice dispensing passage 43. A reference numeral 56 in FIG. 4 denotes a support plate which covers a top portion of a breaking space 57 and also supports the driving shaft 51 so that the driving shaft 51 can rotate.

As shown in FIGS. 4 and 8, the driving device 60 includes a driving motor 61 mounted next to the breaker 50 in the housing 41, and a reduction gear unit 62 having a plurality of gears 63 so as to transmit a rotational force of the driving motor 61 with a reduced speed to the driving shaft 51 of the breaker 50. An output shaft 64 of the reduction gear unit 62, as shown in FIG. 8, is connected to a lower end of the driving shaft 51 of the breaker 50. Therefore, if the driving motor 61 operates, the rotating cutters 52 coupled to the driving shaft 51 are rotated slowly with a large force, and break ice.

The diverting device 70 to divert the ice dispensing path, as shown in FIGS. 4, 7 and 8, is mounted above the first ice dispensing passage 42, and includes a flat plate-shaped diverting member 71 having an upper end hingedly coupled to the top of the housing 41, and a diverting motor 72 mounted in the housing 41 to rotate the diverting member 71. As shown in FIG. 7, the diverting motor 72 is mounted in a sectioned space 45 opposite to the driving motor 61, and is connected to the diverting member 71 by the medium of a rotating link 73 coupled to a shaft of the diverting motor 72. The diverting member 71 is provided with a connecting protrusion 74, which extends from a side end of the diverting member 71 at a distance from the rotational center toward the rotating link 73 by penetrating a partition wall 46. The rotating link 73 is provided with a connecting groove 75, which is formed lengthwise in a longitudinal direction of the rotating link 73, so that the connecting protrusion 74 is slidably coupled to the rotating link 73. As shown in FIG. 8, the partition wall 46 is formed with an arc-shaped guide slot 76 along a rotational trajectory of the connecting protrusion 74, so that the connecting protrusion 74 can be rotated with the diverting member 71.

Figure 9:
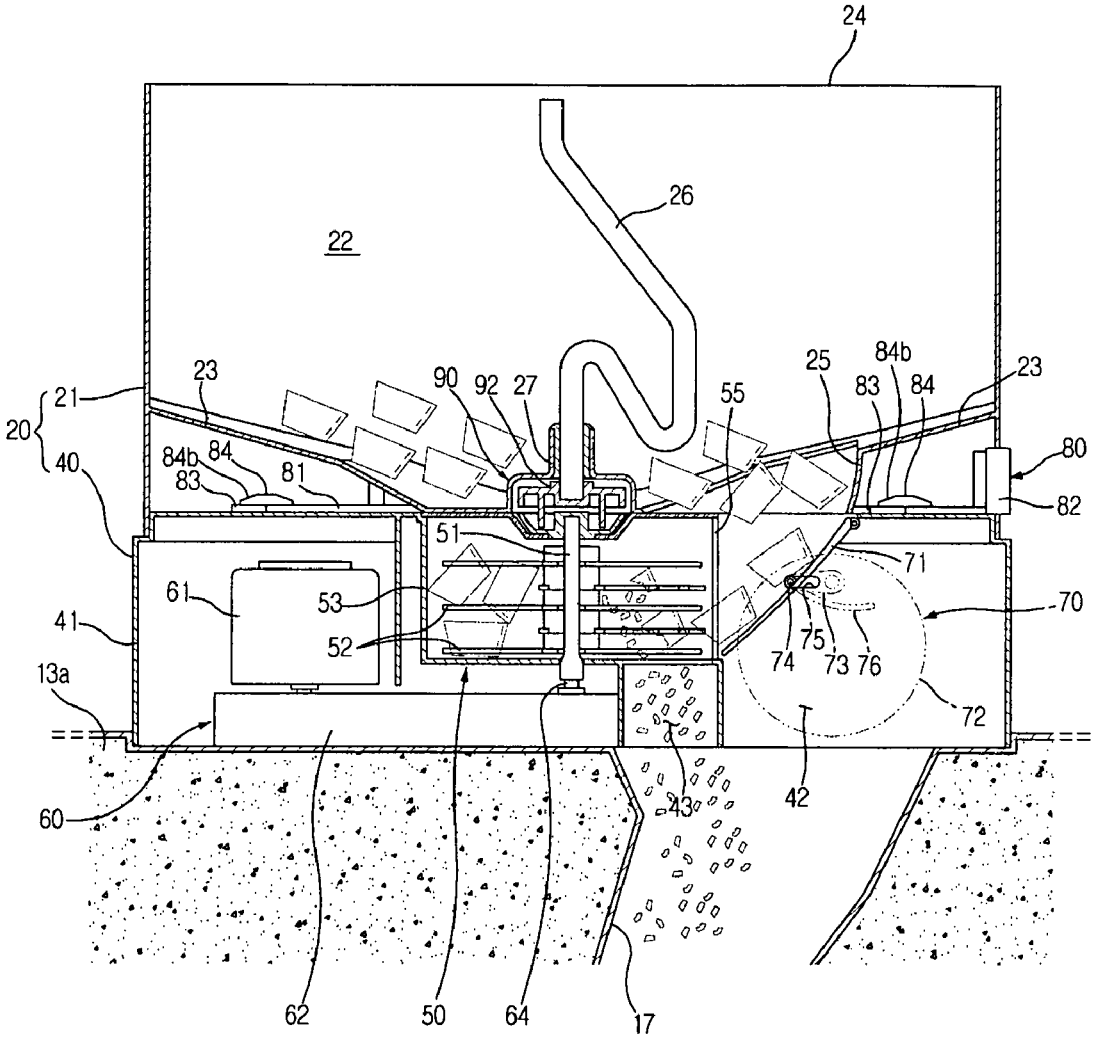
FIG. 9 is a longitudinal-sectional view of an ice supply device according to the present invention, which shows a state of dispensing ice through a second ice dispensing passage.

In the diverting device 70 as structured above, if the rotating link 73 is rotated by the operation of the diverting motor 72, the connecting protrusion 74 slidably coupled to the rotating link 73 moves along the guide slot 76. By such operation, the diverting member 71 is rotated in a forward direction or a reverse direction, and diverts the ice dispensing path. As shown in FIG. 8, if the diverting member 71 opens the first ice dispensing passage 42, the ice is directly discharged to the dispensing chute 17 through the first ice dispensing passage 42. As shown in FIG. 9, if the diverting member 71 closes the first ice dispensing passage 42 and guides ice to the breaker 50, the ice broken by the breaker 50 is discharged to the dispensing chute 17 through the second ice dispensing passage 43. The above-described operation of the diverting device 70 may be achieved automatically in such a manner that a user handles a refrigerator manipulation panel (not shown) to choose a user-desired type of ice, i.e., broken ice or an ice cube, and a refrigerator controller (not shown) controls the diverting motor 72. Although it has been described in this embodiment that the diverting member 71 is operated automatically, if a manual operation lever (not shown) is employed instead of the diverting motor 72, the ice dispensing path can also be diverted by the manual operation of a user.

As described above, the ice storage container 21 according to this embodiment can be separated from the ice breaking unit 40. For this, a binding device 80 is provided at the ice storage container 21 and the ice breaking unit 40 to bind them or release the binding. Also, a power transmitting device 90 is provided at the ice storage container 21 and the ice breaking unit 40, so that a rotational force of the breaker 50 can be transmitted to the auger 26 provided in the ice storage container 21 when the ice storage container 21 is mounted to the ice breaking unit 40.

Figure 5:
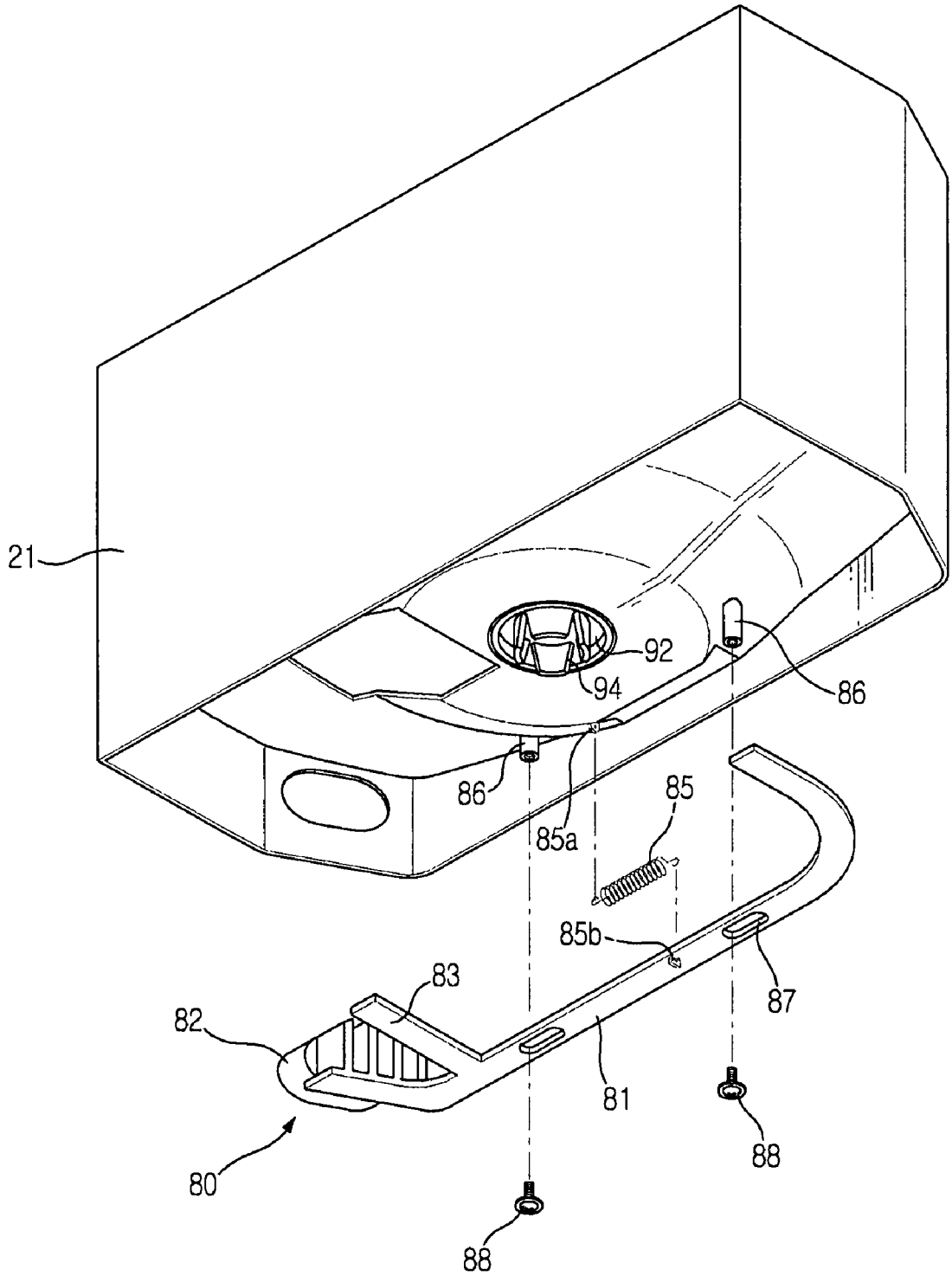
FIG. 5 is a perspective view showing an ice storage container and a binding device of an ice supply device according to the present invention.
Figure 6:
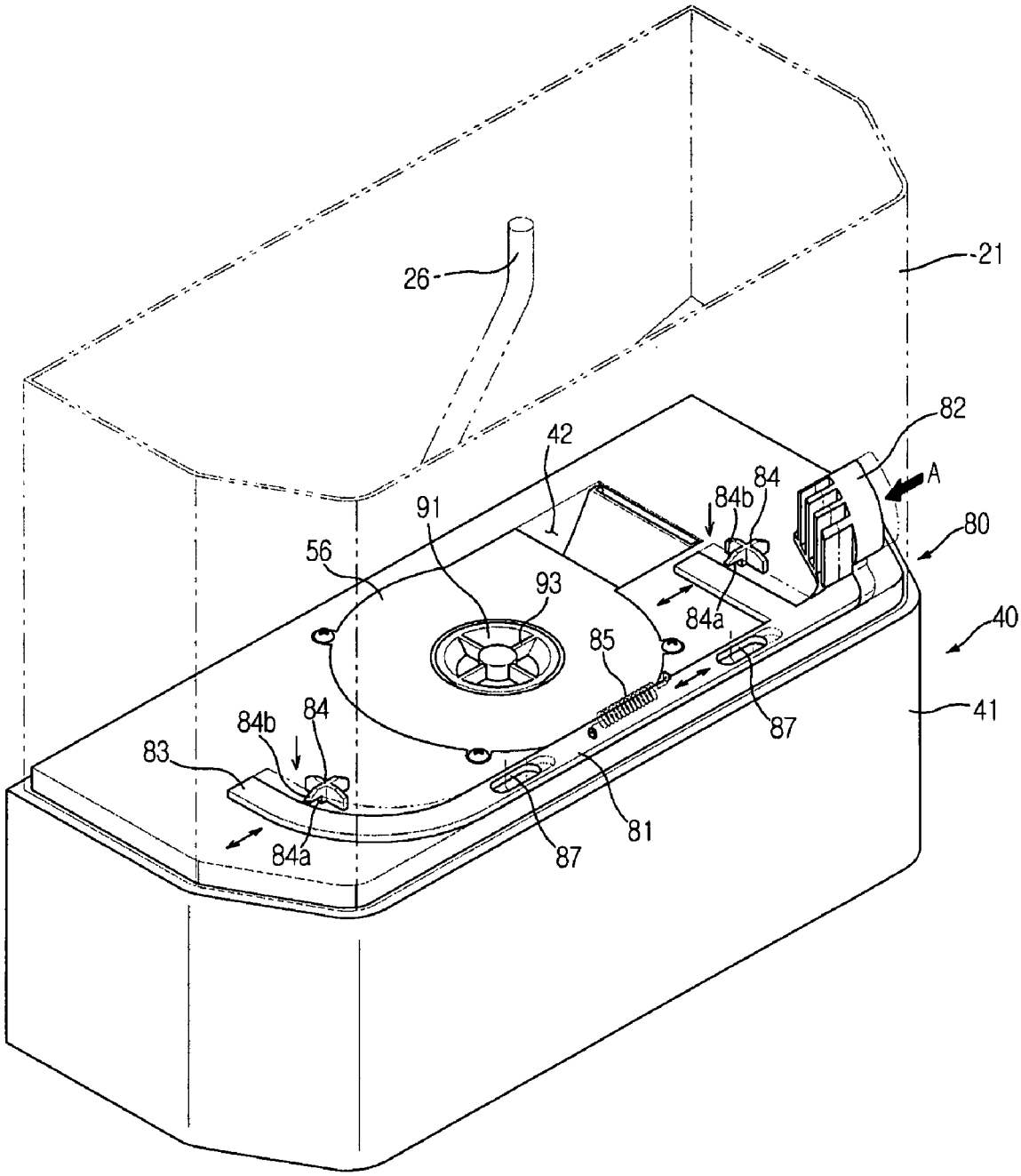
FIG. 6 is a perspective view showing a binding device of an ice supply device according to the present invention.

As shown in FIGS. 4 to 6, the binding device 80 includes a rod-shaped moving member 81 mounted under the ice storage container 21, movably in a traverse direction, a push part 82 connected to an end portion of the moving member 81 and partially exposed to an outside of the ice storage container 21, and two first latching parts 83 provided at both end portions of the moving member 81 with an interval therebetween. The binding device 80 further includes two second latching parts 84 provided at the top surface of the housing 41 of the ice breaking unit 40 so that the first latching parts 83 can be latched by or released from the second latching parts 84, and an elastic member 85 to move the moving member 81 so that the latched state between the first latching parts 83 and the second latching parts 84 can be maintained.

The first latching parts 83 are extended from the moving member 81 in a direction perpendicular to the moving direction of the moving member 81. The second latching parts 84 are formed in a shape protruding upward from the top surface of the housing 41. Each of the second latching parts 84 is provided with a latching protrusion **84*a* at one side portion thereof, by which each of the first latching parts 83 is latched. As shown in FIG. 5, the ice storage container 21 is provided with coupling protrusions 86, which protrude downward from the lower surface of the ice storage container 21 with a predetermined interval therebetween. The moving member 81 is formed with two movement guide slots 87, into which the coupling protrusions 86 are correspondingly fitted. The movement guide slots 87 are extended lengthwise in a longitudinal direction of the moving member 81 to allow the movement of the moving member 81. So as to prevent the coupling protrusions 86 from being separated from the moving member 81, fixing screws 88 are tightened into the coupling protrusions 86. The elastic member 85 is configured as a tensile coil spring, which has a first end fixed to a first fixing part 85*a* provided at the lower surface of the ice storage container 21 and a second end fixed to a second fixing part 85*b* provided at the moving member 81. The elastic member 85 pulls the moving member 81 in a direction of that the first latching parts 83 are latched by the second latching parts 84, thereby maintaining the binding between the first latching parts 83 and the second latching parts 84**.

As shown in FIG. 6, the binding device 80 is operated such that when a user pushes the push part 82 in a direction of an arrow A, the moving member 81 moves so that the first latching parts 83 are released from the second latching parts 84. Thereby, the binding between the ice breaking unit 40 and the ice storage container 21 can be released. Accordingly, in such a state, a user can easily separate the ice storage container 21. Conversely, when intending to install the ice storage container 21, a user performs the installation while pushing the push part 82, and then stops pushing the push part 82 after the installation. If the pushing force on the push part 82 is removed, the first latching parts 83 are moved in the direction of being latched by the second latching parts 84 by the elastic force of the elastic member 85, and then latched by the second latching parts 84. Accordingly, the binding between the ice breaking unit 40 and the ice storage container 21 can be maintained. Because the second latching parts 84 are formed with slanted coupling guide surfaces 84*b* at top surfaces thereof, although a user does not push the push part 82 in installing the ice storage container 21, the ice storage container 21 can be installed to the ice breaking unit 40. This is because the coupling guide surfaces 84*b* of the second latching parts 84 guide the movement of the first latching parts 83 in the process of installing the ice storage container 21 and thus the first latching parts 83 can be latched by the latching protrusions 84*a* of the second latching parts 84, as shown in FIG. 6. Although the present embodiment has been shown with the moving member 81 disposed on the ice storage container 21 and the second latching parts 84 disposed on the ice breaking unit 40, the vice-versa may be true.

The power transmitting device 90, as shown in FIG. 8, includes a first connecting member 91 coupled to the upper end of the driving shaft 51 of the breaker 50, and a second connecting member 92 coupled to the lower end of the auger 26 of the ice storage container 21. As shown in FIG. 6, the first connecting member 91 is provided with coupling walls 93 which are radially formed at an upper portion of the first connecting member 91. As shown in FIG. 5, the second connecting member 92 is provided with coupling teeth 94 which are fitted into gaps between the adjacent coupling walls 93 of the first connecting member 91. Accordingly, if the ice storage container 21 is loaded above the ice breaking unit 40, the first connecting member 91 and the second connecting member 92 are engaged with each other, and thereby a rotational force of the driving shaft 51 can be transmitted to the auger 26.

Although embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An ice supply device, comprising:

an ice breaking unit having a breaker to break ice and a housing to house the breaker;

an ice storage container removably coupled to the ice breaking unit, the ice storage container having a discharge hole to discharge ice; and a binder device to bind the ice storage container and the ice breaking unit, wherein the ice storage container is mounted above the ice breaking unit, wherein the binder device includes a moving member mounted movably under the ice storage container and arranged between the ice breaking unit and the ice storage container when the ice storage container is coupled to the ice breaking unit.

2. The ice supply device according to claim 1, wherein the ice storage container includes an auger rotatably mounted therein, and wherein when the ice storage container is coupled to the ice breaking unit, the auger is connected with the breaker.

3. The ice supply device according to claim 2, wherein the breaker includes a drive shaft mounted in the housing, the drive shaft having a rotational center coinciding with a rotational center of the auger, a plurality of rotating cutters coupled to the drive shaft, an ice guide part provided in the housing to surround the rotating cutters, and a plurality of fixed cutters fixed in the ice guide part to break ice by cooperating with the rotating cutters.

4. The ice supply device according to claim 1, wherein the ice breaking unit includes a drive device mounted in the housing to drive the breaker.

5. The ice supply device according to claim 1, wherein the ice breaking unit includes a first ice dispensing passage formed at the housing so that ice in the ice storage container detours around the breaker and is dispensed, and a second ice dispensing passage formed at the housing so that ice in the ice storage container is dispensed via the breaker.

6. An ice supply device, comprising:

an ice breaking unit having a breaker to break ice and a housing to house the breaker;

an ice storage container removably coupled to the ice breaking unit, the ice storage container having a discharge hole to discharge ice; and a binder device to bind the ice storage container and the ice breaking unit, wherein the binder device includes a first latch movably mounted to the ice storage container, and a second latch provided at the ice breaking unit to latch the first latch.

7. The ice supply device according to claim 6, wherein the binder device further includes an elastic member to move the first latch so that the first latch is latched by the second latch, and a push part connected to the first latch to manipulate the first latch.

8. An ice supply device, comprising:

an ice breaking unit having a breaker to break ice and a housing to house the breaker;

an ice storage container removably coupled to the ice breaking unit, the ice storage container having a discharge hole to discharge ice; and a binder device to bind the ice storage container and the ice breaking unit, wherein the ice storage container is loaded above the ice breaking unit, and the binder device includes a moving member mounted under the ice storage container, movably in a traverse direction, a push part connected to the moving member and partially exposed to an outside of the ice storage container, at least one first latch provided at the moving member, at least one second latch provided at a top of the ice breaking unit so that the first latch is latched by or released from the second latch, and an elastic member to move the moving member so that a latched state between the first latch and the second latch part is maintained.

9. A refrigerator, comprising:

a main body having a freezing compartment;

a door to open or close the freezing compartment, the door having a dispensing chute to dispense ice;

an ice making device mounted in the freezing compartment; and an ice supply device to store ice supplied from the ice making device and supply ice to the dispensing chute, the ice supply device including an ice breaking unit having a breaker mounted to an inner side of the door to break ice and a housing to house the breaker, an ice storage container removably coupled to an upper portion of the ice breaking unit, the ice storage container having a discharge hole to discharge ice, and a binding device to bind the ice storage container and the ice breaking unit or release the binding, wherein the ice storage container is mounted above the ice breaking unit and the ice storage container includes an auger rotatably mounted therein, and wherein when the ice storage container is coupled to the ice breaking unit, the auger is connected with the breaker, wherein the binder device includes a moving member mounted movably under the ice storage container and arranged between the ice breaking unit and the ice storage container when the ice storage container is coupled to the ice breaking unit.

10. The refrigerator according to claim 9, wherein the breaker includes a driving shaft mounted in the housing, the driving shaft having a rotational center coinciding with a rotational center of the auger, a plurality of rotating cutters coupled to the driving shaft, an ice guide part provided in the housing to surround the rotating cutters, and a plurality of fixed cutters fixed in the ice guide part to break ice by cooperating with the rotating cutters.

11. The refrigerator according to claim 9, wherein the ice breaking unit includes a driving device mounted in the housing to drive the breaker.

12. The refrigerator according to claim 9, wherein the ice breaking unit includes a first ice dispensing passage formed at the housing so that ice in the ice storage container detours around the breaker and is dispensed, and a second ice dispensing passage formed at the housing so that ice in the ice storage container is dispensed via the breaker.

13. The refrigerator according to claim 12, wherein the ice breaking unit includes a diverting device to divert an ice dispensing path so that ice is selectively dispensed through any one of the first ice dispensing passage and the second ice dispensing passage.

14. The refrigerator according to claim 13, wherein the diverting device includes a diverting member hingedly mounted in the housing to divert the ice dispensing path, and a diverting motor to rotate the diverting member.

15. A refrigerator comprising:

a main body having a freezing compartment;

a door to open or close the freezing compartment, the door having a dispensing chute to dispense ice;

an ice making device mounted in the freezing compartment; and an ice supply device to store ice supplied from the ice making device and supply ice to the dispensing chute, the ice supply device including an ice breaking unit having a breaker mounted to an inner side of the door to break ice and a housing to house the breaker, an ice storage container removably coupled to an upper portion of the ice breaking unit, the ice storage container having a discharge hole to discharge ice, and a binding device to bind the ice storage container and the ice breaking unit or release the binding, wherein the binding device includes a first latching part movably mounted to the ice storage container, and a second latching part provided at the ice breaking unit to latch the first latching part.

16. The refrigerator according to claim 15, wherein the binding device further includes an elastic member to move the first latching part so that the first latching part is latched by the second latching part, and a push part connected to the first latching part to manipulate the first latching part.

17. A refrigerator, comprising:

a main body having a freezing compartment;

a door to open or close the freezing compartment, the door having a dispensing chute to dispense ice;

an ice making device mounted in the freezing compartment; and an ice supply device to store ice supplied from the ice making device and supply ice to the dispensing chute, the ice supply device including an ice breaking unit having a breaker mounted to an inner side of the door to break ice and a housing to house the breaker, an ice storage container removably coupled to an upper portion of the ice breaking unit, the ice storage container having a discharge hole to discharge ice, and a binding device to bind the ice storage container and the ice breaking unit or release the binding, wherein the binding device includes a moving member mounted under the ice storage container, movably in a traverse direction, a push part connected to the moving member and partially exposed to an outside of the ice storage container, at least one first latching part provided at the moving member, at least one second latching part provided at a top of the ice breaking unit so that the first latching part is latched by or released from the second latching part, and an elastic member to move the moving member so that a latched state between the first latching part and the second latching part is maintained.

18. A refrigerator, comprising:

a main body having a freezing compartment;

a door to open or close the freezing compartment, the door having a dispensing chute to dispense ice;

an ice making device mounted in the freezing compartment; and an ice supply device to store ice supplied from the ice making device and supply ice to the dispensing chute, the ice supply device including an ice breaking unit having a breaker mounted to an inner side of the door to break ice and a housing to house the breaker, and an ice storage container removably coupled to an upper portion of the ice breaking unit, wherein the ice storage container is mounted above the ice breaking unit, wherein the binder device includes a moving member mounted movably under the ice storage container and arranged between the ice breaking unit and the ice storage container when the ice storage container is coupled to the ice breaking unit.

19. The ice supply device according to claim 1 wherein the binder device includes a first latch on the ice storage container and a second latch on the ice breaking unit.

20. The ice supply device according to claim 19, wherein either one of the first latch or the second latch is operable to release the first latch from the second latch.

21. The ice supply device according to claim 20, wherein the first latch is operable to release the first latch from the second latch.

22. The ice supply device according to claim 2, further comprising a protrusion formed on the ice storage container and a cut out formed on the ice breaking unit.

* * * * *